US005113884A

United States Patent [19]

Melgeorge

[11] Patent Number: 5,113,884

[45] Date of Patent: May 19, 1992

[54] AUTOMATIC HOSE WASHER

[76] Inventor: Edward L. Melgeorge, R.R. 1, Box 2222H, Nashwauk, Minn. 55769

[21] Appl. No.: 581,741

[22] Filed: Sep. 13, 1990

[51] Int. Cl.[5] ..... B08B 3/02

[52] U.S. Cl. ..... 134/122 R; 134/199; 100/176

[58] Field of Search ..... 134/64 R, 64 P, 122 R, 134/122 P, 199, 166 C; 100/176, 100, 171

[56] References Cited

U.S. PATENT DOCUMENTS

| | | | |
|---|---|---|---|
| 415,935 | 11/1887 | Boynton et al. | 134/64 R |
| 425,642 | 4/1890 | Villeneuve | 134/122 R |
| 447,634 | 3/1891 | Cosby | 134/64 R |
| 491,821 | 2/1893 | Taber | 134/122 R |
| 810,259 | 1/1906 | Britton | 134/122 R |
| 1,585,408 | 4/1926 | Morse | 134/64 P |
| 1,641,204 | 9/1927 | Shattuck | 68/254 |
| 2,651,312 | 9/1953 | McBeth | 134/122 R |
| 3,181,455 | 5/1965 | Gouker et al. | 100/176 |
| 3,531,059 | 9/1970 | Walker | 242/86.2 |
| 3,601,038 | 8/1971 | Hayes | 100/100 |
| 3,827,097 | 8/1974 | Hamann | 15/40 |
| 3,866,532 | 2/1975 | Ogden, Jr. | 100/171 |
| 3,966,544 | 6/1976 | Johnson | 162/275 X |
| 4,161,182 | 7/1979 | Burton | 134/166 C |
| 4,280,672 | 7/1981 | Santos et al. | 242/86 |
| 4,438,781 | 9/1982 | Wahlstrom et al. | 15/40 |
| 4,502,175 | 3/1985 | Hillis | 15/104.92 |
| 4,503,577 | 3/1985 | Fowler | 134/64 R |

OTHER PUBLICATIONS

Essentials of Firefighting, copyright Jun. 1983, International Fire Service Training Association (IFSTA), pp. 220–221.

*Primary Examiner*—Frankie L. Stinson

*Attorney, Agent, or Firm*—Merchant, Gould, Smith, Edell, Welter & Schmidt

[57] ABSTRACT

A high water pressure, fire hose washing apparatus generally having a back plate, cleaning heads with spray nozzles mounted to the back plate, and optionally, guide rollers rotatably mounted to the back plate and oriented to direct hose in a generally serpentine pattern, a drive roller and a pressure roller rotatably mounted to the back plate. Optionally, the washing apparatus may also comprise means for taking up washed hose, and means for loading hose into the hose washing apparatus. Also disclosed is a method of using the high water pressure hose washing apparatus and a high water pressure cleaning system.

19 Claims, 2 Drawing Sheets

AUTOMATIC HOSE WASHER

FIELD OF THE INVENTION

The present invention relates generally to automatic hose washers. More specifically, the present invention relates to means for washing large volume hoses such as fire hose and the like at a high rate through the application of high pressure water.

BACKGROUND OF THE INVENTION

High volume hose has always presented maintenance and care concerns regardless of the application in which it is used. Unlike hose used by the residential homeowner, high volume hose such as that used by fire departments, mining companies, air carriers, and in farming irrigation operations tends to comprise a heavy work piece of considerable dimension. The length and weight of the hose necessitate extended effort in laying and charging the hose as well as in recovery and care of the hose after use.

Additionally, the applications in which this type of hose is used often result in extended exposure to dirt, soot, cinders, ash, degrading solvents and the like. The environmental conditions in which a hose is used may also result in exposure to flame and high temperature, truck traffic over the hoses, and other pressures and stresses not encountered by conventional garden hose. As a result, hose cleaning must be undertaken to both maintain the structural integrity of the hose and to ensure that a prior application has not compromised the hose. Operator safety is often dependent on careful inspection and recognition of structural inadequacies in hose.

In the case of fire hose, each length comprises a substantial capital investment by a fire department. Moreover, substantial energy is invested, usually through the manual labor of fire department personnel, in washing, rinsing, and drying hose. Generally, fire hose is washed by laying the hose flat on the floor of the department garage. Water is then applied and the hose is then manually scrubbed with a brush and soap. As each fire truck may carry thousands of feet of hose, manual washing can take hours. Moreover, once the hose has been washed it is generally hung in a drying tower or the like prior to repacking on the fire truck.

To save the investment of time and energy in the care and maintenance of hose a number of devices have been developed. For example, U.S. Pat. No. 3,531,059 to T. J. Walker discloses a fire hose loader, cleaner and drier contained within a mobile apparatus such as a panel truck. U.S. Pat. No. 4,502,175 to Hillis discloses a portable fire hose cleaning apparatus adapted to be connected to a conventional fire hydrant. In operation, the hose is manually manipulated between the brushes and the members in order to adequately wet and clean its outer surface.

U.S. Pat. No. 4,438,781 to Wahlstrom et al discloses a hose cleaning plant which comprises a hose magazine, washing equipment, and a hose transport device which in operation pulls the hose through washing equipment over the extended length of the hose cleaning plant. U.S. Pat. No. 4,280,672 to Santos et al discloses a compact fire hose washer generally comprising means for wetting the hose, introducing soap onto the surface of the hose, scrubbing the hose, and rinsing the hose.

U.S. Pat. No. 3,827,097 to Hamann discloses a hose washer which may be used for large volume hose such as fire hose or agricultural irrigation hose comprising a washer inside a guide chamber which passes the washed hose onto a spindle. In operation, hose passes through the guide chamber comprising an outer housing and inner perforate shell. Once in the guide chamber, the hose is contacted with a water flow injected into the outer housing of the guide chamber and directed onto the hose by the inner perforated shell.

Essentials of Firefighting, Copyright June, 1983, International Fire Service Training Association (IFSTA) disclose methods and devices for washing and drying fire hose. Specifically, in FIGS. 10.3 and 10.4 shown on page 220, there are two fire hose washing apparatuses shown. The first fire hose washer, FIG. 10.3, uses the flow of water into a cylindrical pipe to wash fire hose up to 3 inches in diameter. Optionally, the water pressure in the device can be used to facilitate the movement of hose through the pipe. Another type of hose washing apparatus is shown in FIG. 10.4 using a series of brushes and rollers to effectively wet, scrub, and drain fire hose.

However, a large problem with industrial hose is that the hose is exposed to elements which do not lend themselves to cleaning with the manual application of soap, water, and brush. For example, hose which generally has a cloth outer wrap, is often exposed to dirt and other contaminants which cannot be removed by the previously mentioned practices and devices. Additionally, hose washing machines previously available do not readily accommodate the high volume of hose soiled, or the severe level of sediment and residue, often resulting from various applications, such as fire scenes, without extended physical labor. Accordingly, a need exists for an industrial hose washing apparatus capable of cleaning hose which has been exposed to severe environmental conditions and soiled as a result of that exposure.

SUMMARY OF THE INVENTION

Before the present invention, high pressure water has not been used or applied to the cleaning of hose. The present invention provides a hose cleaning apparatus using high pressure water and an automatic drive mechanism to pull hose through the apparatus with minimal manual labor. The apparatus of the present invention applies high pressure water to hose. The present invention is especially suited to remove ground-in residue from the cloth outer wrapping of fire hose. The apparatus of the present invention is capable of cleaning any hose in an efficient and thorough manner including hose which has a flat profile when uncharged.

In accordance with the present invention there is provided a high water pressure, hose washing apparatus which generally includes a back plate and cleaning heads mounted to the back plate. The present invention may also comprises one or more guide rollers rotatably attached to the back plate. Each guide roller may generally be positioned adjacent the water cleaning head.

The present invention may also generally comprises a drive roller attached to the back plate. The drive roller is rotatable at various speeds by connection of the drive roller to an external power source. The present invention's drive system also comprises a pressure roller positioned in tension contact with the drive roller and attached to the back plate by a spring. Optionally, the apparatus of the present invention may also include a reel for loading hose into the hose washing apparatus.

The present invention also provides a method of using a high water pressure hose washing apparatus and a high pressure cleaning system using the hose washer of the present invention.

DETAILED DESCRIPTION OF THE PREFERRED EMBODIMENTS

The present invention comprises a high water pressure hose cleaner, a method of using a high water pressure hose cleaner, and a high pressure cleaning system which has a high pressure hose cleaner as an accessory to the system.

HIGH PRESSURE HOSE CLEANER

Figure 1:
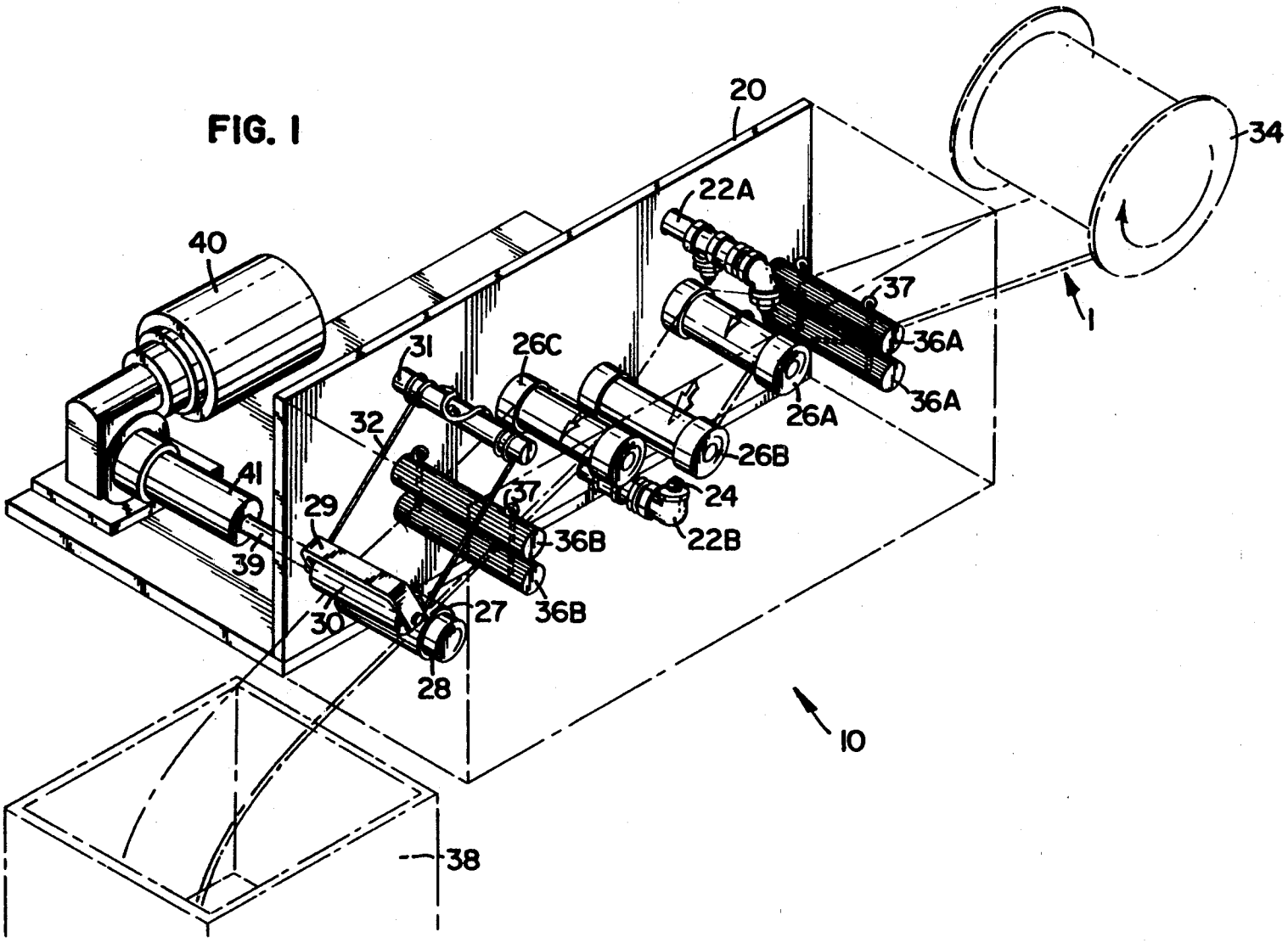
FIG. 1 is a perspective view of a high pressure hose washing apparatus in accordance with a preferred embodiment of the present invention.

Referring to the Figures wherein like parts are designated similarly through several views, a high pressure hose cleaner 10 is shown in FIG. 1. The high water pressure, hose washing apparatus 10 generally includes a back plate 20 of a given thickness, length, and width sufficient to support the apparatus. Mounted on the back plate 20 are cleaning heads 22A and 22B. The cleaning heads 22A and 22B are attached to the back plate 20 and pass through and extend outwardly beyond and perpendicular to the back plate 20. The cleaning heads generally have nozzles 24 positioned across their length. The spray nozzles 24 are positioned to direct the water generally parallel to the back plate 20. In the most preferred embodiment, the nozzles of cleaning head 22A are directed downwardly towards guide roller 26A and the nozzles 24 of cleaning head 22B are directed upwardly towards guide roller 26B.

Preferably, the present invention has three guide rollers 26A, 26B, 26C each extending outwardly from, and rotatably attached to, the back plate 20. Preferably, the guide rollers are oriented to direct hose 1 in a generally serpentine pattern through the apparatus, FIG. 2. The first guide roller 26A may be attached to the back plate adjacent the first cleaning head 22A. Another guide roller 26B may be positioned adjacent the second cleaning head 22B in the path of the spray nozzles 24. A third guide roller 26C may generally be positioned upward from the second guide roller towards the top and second side edge on the back plate 20 to assist in guiding the hose through the drive system.

The present invention may also comprise a drive system including a drive roller 28 rotatably attached to the back plate 20. The drive roller 28 extends outward from the back plate. The drive roller 28 rotates at various speeds by connection to an external power source 40, FIGS. 1 and 3. Meeting the drive roller 28 is a pressure roller 30 positioned in tension contact with the drive roller 28. The pressure roller 30 is affixed to the back plate 20 by a spring 32 anchored by stationary pin 31.

Figure 2:
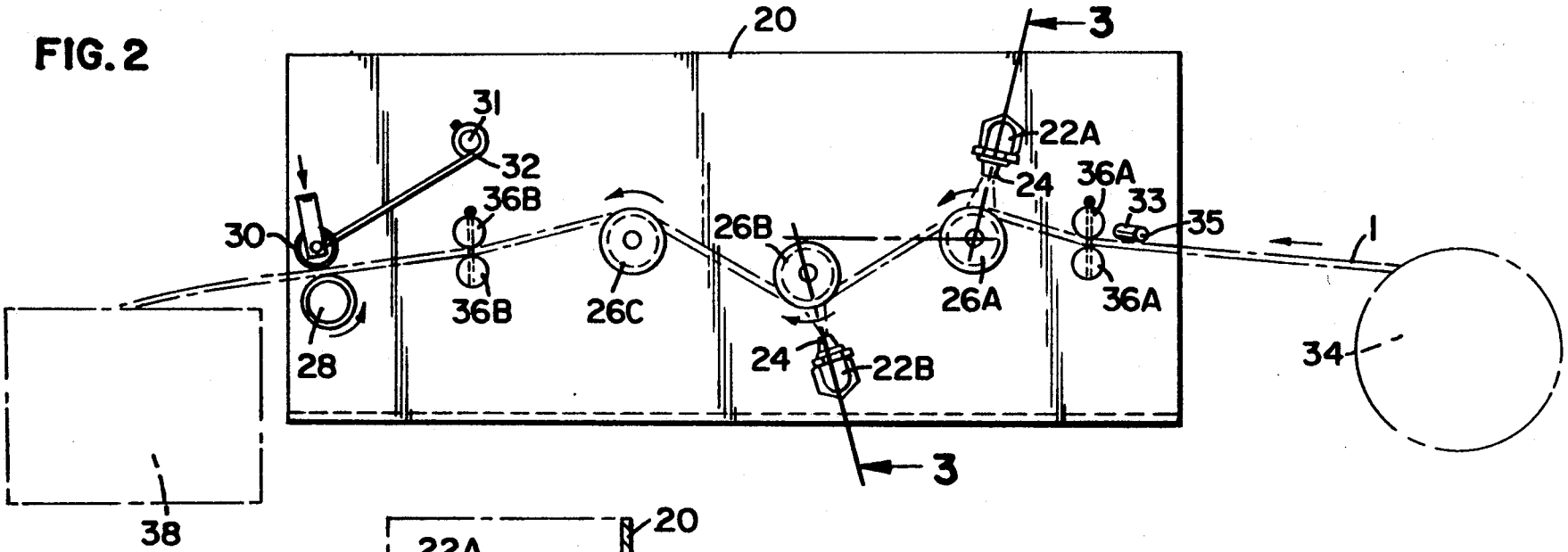
FIG. 2 is a side elevational view of a high pressure hose washing apparatus shown in FIG. 1 in accordance with a preferred embodiment of the present invention.

Turning to the specific features of the present invention, a back plate 20 provides structural support, weight and portability to the apparatus of the present invention, FIGS. 1 and 2. Generally, the back plate 20 may take on any configuration which provides a structure of adequate strength, weight and size to support various elements of the hose washing apparatus.

Materials generally useful for forming a back plate of adequate strength include metal alloys such as steel, iron, alloyed aluminum and the like. Also useful are modern high strength polymers such as para-aramides which combine strength with optimal weight characteristics. Due to the high exposure to water, the back plate is preferably made from or coated with rust resistant materials. One type of coating especially preferred is epoxy paints due to their wearability and hardness.

Figure 3:
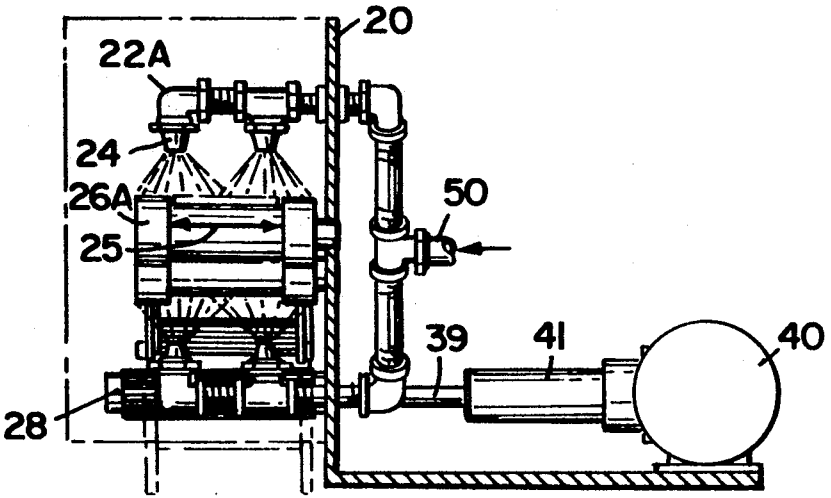
FIG. 3 is a cross-sectional view taken along line 3—3 showing a preferred embodiment of the present invention as depicted in FIG. 2 and further showing cleaning heads and water nozzles as well as guide rollers used in the present invention.

Preferably, as can be seen in FIGS. 1–3, the back plate 20 is generally square having a top edge, a bottom edge, and two side edges. Generally the most preferable material for use as a back plate is stainless steel or alloyed aluminum having a thickness varying from about ⅛ inch to about ¼ inch. These metal alloys are most desirable for the ready attachment of various elements of the apparatus through soldering, spot welding, or preferably by threading and bolting. In practice, bolting the various elements to the back plate 20 has been found to be the most effective means of attaching elements to the back plate. Bolting elements to the back plate 20 allows for easy replacement or maintenance of parts or intercharging of elements having a different size to accommodate the cleaning of hose of various size.

Although the size of the back plate can vary considerably in dimension, the height of the back plate generally varies from about 9 inches to about 16 inches and the length of the back plate generally varies from about 24 inches to about 48 inches. This range in size allows for the adequate spacing and positioning of the elements of the hose washing apparatus including guide rollers, washing means, and guide pins.

Although the Figures in the present application depict the present invention as exposed, any variety of covers may also be used to enclose the motor 40 or apparatus 10. Generally, these housings function to contain water spray during operation, protect the apparatus operator, and protect the motor from damage. The apparatus may be covered by a metal alloy or polymeric hood hinged at the top edge of the back plate 20. Similarly, the engine may be covered with a metal alloy hood. This allows the hood to be flipped up prior to or after operation. Preferably, the hood is made of a clear plexiglass, allowing visible operation of the apparatus with the hood in place.

The present invention also comprises means for applying a high pressure spray of water to the hose. Generally, the hose washing means functions to direct water towards a specific area through which the hose will pass applying a pressurized water flow over the surface of the hose. This pressurized water flow is intended to dissolve and dislodge particulate residue and sediment stuck on the surface of the hose.

Generally, the hose washing means may take on any number of configurations, which for example, may be as simple as the use of a single cleaning head having two nozzles for the application of pressurized water flow to the hose. In this instance, hose may be run through the apparatus twice in order to clean both sides adequately.

Preferably, as can be seen in FIGS. 1–3, the hose washing means of the present invention comprises a pair of cleaning heads 22A, 22B which extend outwardly from the back plate over the guide rollers 26A and 26B. The cleaning heads 22A, 22B have any number of nozzles 24 across the length of the head. While the cleaning heads 22A, 22B may be positioned in any variety of configurations, as can be seen in FIG. 2, cleaning heads 22A and 22B are preferably configured in a diagonal orientation in relationship to each other.

Further, cleaning heads 22A and 22B are generally cocked back at an angle in relationship to guide rollers 26A and 26B, FIG. 2. The angle of the cleaning heads in conjunction with the serpentine pattern of the hose as it is pulled over the guide rollers 26A and 26B facilitates the further penetration of the cloth outer wrap or an otherwise irregular outer casing where residue and particulate may become lodged or embedded. Moreover, the use of two cleaning heads positioned on either side of the hose provides for the efficient cleaning of the hose with one pass through the machine.

Cleaning action by the apparatus of the present invention is dependent upon water flow and water pressure. The value of these two parameters depends upon the residue to be removed from the hose. Generally, the cleaning heads may have any inner diameter necessary to provide the necessary water flow and pressure thus providing the necessary force and irrigation to remove residue. Preferably, the inner diameter of the cleaning head ranges from about 0.25 inch to 0.4 inch. Most preferably, the cleaning heads are attached to the back plate 20 through keyed, quick disconnects. For example, in use, attachment through quick disconnects allows easy replacement of a cleaning head generally having two nozzles, for a 1.5 inch diameter hose, with a cleaning head generally having four nozzles, for a 5 inch diameter hose. Generally, the cleaning heads are also preferably angled to direct water towards the drive roller in the direction the hose is being pulled through the apparatus. Keying the quick disconnects assures that the nozzles always retain the same angle in relationship to their respective guide roller.

Turning to the nozzles 24, any variety of nozzle sizes, angles and material may be used in accordance with the present invention. Generally, the number of nozzles used may vary depending upon available water flow and pressure, and the size and condition of hose to be washed. Preferred systems generally comprise cleaning heads having two to four nozzles mounted thereon.

Generally, nozzles are rated on the basis of the angle of water projected from the nozzle head during use and the water flow useful for any specific nozzle. Preferred nozzles have a narrow or more direct spray pattern such as, for example, a 15 - 02 nozzle as nozzle size is accepted and defined by those of skill in this art. However, it is also preferable to have a nozzle which provides adequate coverage over the hose surface to provide efficient cleaning. Adequate coverage may be obtained by using more nozzles or nozzles providing a larger angle of water spray. The nozzle size may be varied depending on the size of the hose and the available water pressure. Most preferably, the cleaning head used in accordance with the present invention comprise four nozzles of size 40 - 04. This nozzle size combines the optimum coverage of hose surface with a substantially narrow spray pattern. Materials useful in forming the nozzles of the present invention include ceramics, metal alloys and the like. These materials are also useful in forming the cleaning heads of the present invention.

Generally, the hose washing apparatus of the present invention may be used as an accessory of a high pressure water system or as a free standing hose washing apparatus having its own source of high pressure water. Any supply of water which may adequately be attached to the system 50 at the back plate and supply the appropriate pressure and volume of water may be used, FIG. 3. Preferred pressure for use in the present invention generally ranges from about 200 psi to 1000 psi, more preferably about 500 psi to 900 psi, and most preferably from about 650 psi to 750 psi. The water flow generally ranges from about 2 gpm to 10 gpm, and most preferably from about 5 gpm to 7 gpm. These ranges are merely guidelines. However, these ranges provide the most efficient cleaning of hose having all types and varieties of residue and contaminants contained therein.

In order to facilitate the transport of hose through the hose washing apparatus of the present invention, there may also be provided guide rollers. Generally, any number of guide rollers may be used in the present invention. These guide rollers may be positioned adjacent to the cleaning heads 22A and 22B in order to facilitate transport of the hose 1 through the apparatus 10, FIG. 2.

In accordance with the present invention it is generally desirable to have a guide roller positioned within exposed to high pressure water flow immediately in the path of water flowing from nozzles 24 and adjacent to the back plate 20. The guide rollers also function in the most preferred embodiment of the present invention to bend the hose in a serpentine pattern, FIG. 2, further exposing the nap of the hose cloth outerlining to the area underneath the spray nozzles 24.

The rollers generally comprise a sleeve rotatably attached through the application of a pin or bolt to the back plate 20. The sleeve may be any number of compositions including metal alloys, or high strength synthetic polymer compositions such as polyurethanes which may have a variable hardness depending upon the application.

Washers may be used at the interface between the bolt end and the sleeve, and the sleeve and the back plate to ensure free rotation of guide rollers. If guide rollers are attached to the back plate 20 by bolting, generally two nuts are used on either side of back plate 20 to ensure free rotation of the cylinder as well as adequate structural support. As the guide rollers may be constructed without bearings, the sleeve materials found most preferable are those having a high material hardness. Optimally, materials having a hardness of 90 durometers or greater have been found preferable. Materials which are self-lubricating or water lubricated be used in the present invention. One material believed preferable for use as a guide roller sleeve includes varying grades of nylon.

Optionally, the roller 26A may also be slotted with groove 25, FIG. 3 to adequately carry hose of any given number of widths through the hose washing apparatus. The length of the guide rollers, cleaning heads, drive roller, and pressure roller along with the guide pins of the hose washing apparatus of the present invention may all be varied by intercharging these parts depending on the width of hose which is to be cleaned. Alternatively, the present invention may be provided with, for example, a drive roller, cleaning heads and guide rollers of a certain length with variable hose widths accommodated by varying the sizes or settings of the guide pins.

In conjunction with guide rollers, the present invention may also comprise a drive system. The drive system functions to transport hose through the machine and in its most preferred mode reduces the volume of water left on the hose after washing by wringing the hose.

Generally, the drive system may be any configuration of elements which facilitate transport of the hose through the hose washing apparatus of the present invention. Preferably, as can be seen in FIG. 2, the drive system comprises a drive roller 28 and a pressure roller 30. The drive roller 28 generally comprises a controllably rotatable sleeve which again is attached to the back plate 20 through any variety of means known to those of skill in the art. Simultaneously, the drive roller is preferably externally connected to any number of means for providing power effective in transporting the hose through the apparatus.

Preferably, the drive roller will be attached to means such as an electric or fossil fuel driven motor 40, FIG. 1, used to power the drive system. In this specific instance, shaft 39 extends from coupling 41 through the back plate 20 in front of the back plate 20. The drive roller 28 is then generally fastened to the shaft 39. Optionally, drive roller 28 may also comprise splines or notches to create a friction between rollers 28 and 30. In turn, shaft 39 may be keyed through coupling 41 to the motor 40.

One advantage of the present invention is the application of high pressure water which allows for efficient cleaning in a much shorter time period than prior art processes. As a result, the drive roller 28 may be set through motor 40 to move at a rate which effectively pulls the hose through the apparatus at a rate ranging from about 4 ft/min to about 15 ft/min. These ranges are only guidelines which depend substantially on the condition of the hose. However, these ranges have been found to maximize the efficiency of cleaning while also providing an economical use of cleaning time.

The drive system of the present invention preferably also comprises a pressure roller 30, FIG. 2. While the drive roller 28 of the present invention provides a means for transporting the work piece or hose through the apparatus, the pressure roller 30 facilitates the driving process by maintaining tension upon the hose. The pressure roller pinches or secures the hose between itself and the drive roller resulting in the friction pulling of hose through the drive system and apparatus. In the process of maintaining a tension grip on the hose, the pressure roller also effectively forces or wrings water from the body of the hose. The pressure roller will have this effect on hose regardless of the nature of the outer lining of the hose, cloth or otherwise.

In the most preferred embodiment, the pressure roller lies parallel to the drive roller and is in tension contact with the drive roller 28. The tension contact of the pressure roller results from the application of spring 32 which is in turn affixed to stationary pin 31. Pin 31, in turn, may be attached to back plate 20 through any number of means known to those of skill in the art including bolting. Optionally, the pressure roller 30 may also comprise a handle 29. The handle 29 allows easy insertion as well as removal of the hose once the cleaning operations have been completed.

Optionally, the hose washing apparatus of the present invention may also comprise sets of guide pins 36A and 36B, FIG. 2. The guide pins further facilitate transport of the hose through the apparatus of the present invention. Generally, the guide pins may take any position or shape which facilitates this purpose.

Preferably, as can be seen in FIGS. 1 and 2, the guide pins are positioned in two locations, the first set of guide pins is positioned on the leading edge or first edge of the back plate at which point the hose is introduced into the apparatus. This set of guide pins may be positioned in front of the first guide roller 26A and cleaning head 22A. Here again, the guide pins may be affixed to the back plate 20 through any variety of means known to those of skill in the art such as bolting and the like.

The second set of guide pins 36B is preferably positioned between the third guide roller 26c and the drive system, drive roller 28 and pressure roller 30, FIG. 2. Here again, this set of guide pins 36B facilitates transport of the hose from the third guide roller 26C through the drive system so that the hose is positioned properly on the rollers.

Preferably, the sets of guide pins 36A and 36B are configured so that they can be adjusted through set pins 37, FIGS. 1 and 2. In accordance with this mode of the present invention, the guide pin sets would have apertures at various distances across the length of the guide pins. These apertures would correspond to various widths of hose to be applied and processed by the process of the present invention. By narrowing the distance between the set pins 37 on any given set of guide pins, the guide pins would be set to accommodate hose of a narrower or broader width.

Alternatively, guide wires may be used to draw and guide hose over the guide rollers and through the apparatus. In this instance, guide wires having varying widths are attached to the guide rollers in the path of nozzles 24. The guide wires may be fit to the guide rollers through any variety of attaching mechanisms such as friction fitting, bolting and the like. In turn, the guide wires may be constructed from high strength wire such as alloyed aluminum, steel or stainless steel. The use of wire having a high strength allows using narrower wire, such as diameters ranging from about 3/16 inch to ⅜ inch, which does not obstruct the flow of water to the hose surface as it passes over the guide roller. The guide wire may also be fit to various sizes allowing the use of one standard size of guide roller and cleaning head and alternating the size of guide wire to accommodate different width hoses.

The hose washing apparatus of the present invention may optionally also comprise means for taking up and dispensing hose. These elements provide ease in coordinating hose which is to be washed and processed by the hose washing apparatus of the present invention. Generally, dispensing means may be any number of elements such as reel 34, FIG. 2, which allows for dispensing hose through the apparatus of the present invention.

In turn, take up means may also be any number of mechanisms including a reel, bin or other such means. For example, a reel may either be manually driven or mechanically driven to accept the hose which has been processed by the apparatus of the present invention. A take up reel may be powered by hand crank, electrically driven motor, fossil fuel driven motor, or any other means known to those of skill in the art. The take up reel may even further be driven by the motor used to empower drive roller 28 with the provision of proper gearing to allow for a coordination of speed between the rate of the drive roller 28 revolution and the rate of revolution of the take up reel.

As shown in FIGS. 1 and 2, a bin may also be used to capture hose as it is processed by the apparatus. The hose may then be manually wound or transported to a drying rack or tower. While any number of means have been discussed a bin has been found preferable.

The hose washing apparatus of the present invention may also comprise a tripping mechanism which is interconnected with the drive roller 28. In certain instances, it may be desirable to wash hose which has end couplings of substantial size and weight, such as for example, fire hose. This type of coupling may not pass easily through the apparatus of the present invention. Accordingly, a trip mechanism or bar 35 may be set up at the first or leading edge of the back plate 20 to trigger by mechanical or electrical interconnect which interrupts the revolution of the drive system and specifically the drive roller 28.

Generally, any trip mechanism known to those of skill in the art may be used which will adequately provide for terminating the revolution of the drive roller under the appropriate circumstances. Preferably, a trip bar 35 would be placed adjacent the first set of guide pins 36A, if present, or the first guide roller 26A. The trip bar 35 may be placed through a slot 33 in back plate 20 and may be slidable within that slot. Within the slot, the trip bar is held towards the front edge of the back plate 20 by tension created by means such as the spring. Upon passing of a hose coupling to the apparatus, the trip bar 35 retracts within the slot thereby activating a mechanical or electrical interconnect which interrupts the revolution of the drive roller 28.

As noted earlier, the apparatus of the present invention may be used as a self-standing hose cleaning machine through an independent high pressure water source 50, FIG. 3. Alternatively, the high pressure hose cleaner of the present invention may also be used as an accessory to a high pressure water system. In this instance, the present invention may be used as an accessory for any number of high pressure water systems such as those sold by Aaladin Inc., Hotsy Inc., and L and A, Inc.

In application, the apparatus of the present invention is used by merely loading the hose from let out reel 34 into the apparatus. In the case of hose comprising couplings, the hose most appropriately may be loaded from a dispensing reel 34 threaded through the various points in the apparatus, i.e. over the guide rollers and through the drive system. The hose washing apparatus of the present invention is activated by initiating the flow of high pressure water and subsequent manual or mechanical movement of the drive system to pull the hose through the apparatus. Once the hose is completely processed, it may be fully dispensed into bin 38 and, depending upon type of hose, either rolled or placed in a hanging tower for completed drying.

The above discussion, examples, and embodiments illustrate my current understanding of the invention. However, since many variations in the invention can be made without departing from the spirit and scope of the invention, the invention resides wholly in the claims hereafter appended.

I claim as my invention:

1. A hose washing apparatus comprising:

(a) means for supporting the apparatus comprising a substantially rigid structure, (b) means for supporting the hose on the apparatus, said hose support means affixed to said apparatus support means, (c) a high pressure water source in communication with said apparatus producing water at a pressure ranging from about 200 psi to 1000 psi, (d) high pressure water means for washing hose mounted on said apparatus support means, said high pressure water means in communication with said high pressure water source and comprising one or more nozzles for directing a high pressure flow of water onto hose in an area adjacent said apparatus support means, and (e) means for guiding hose through the apparatus, said guiding means rotatably mounted to said apparatus support means and comprising at least one guide roller, said guide roller comprising a length extending outwardly from said apparatus support means and oriented generally perpendicular relative to said apparatus support means, said guide roller mounted to said apparatus support means adjacent said hose washing means in the path of said nozzles.

2. The apparatus of claim 1 wherein said apparatus support means comprises a rigid back plate having a thickness, length and width adequate to support the hose washing apparatus, said apparatus support means further comprising a top and bottom edge, and first and second side edges.

3. The apparatus of claim 2 comprising means for driving hose through the apparatus, said drive means comprising a drive roller and a pressure roller each mounted to said apparatus support means, said drive roller positioned adjacent said apparatus support means second side edge, said pressure roller comprising a rotatable length in tension contact with said drive roller, said pressure roller positioned parallel to said drive roller and perpendicular to said apparatus support means, said pressure roller supportably mounted to said apparatus support means through a spring.

4. The apparatus of claim 3 wherein said drive roller is externally connected to a power source used to rotate said drive roller.

5. The apparatus of claim 4 additionally comprising means for interrupting the revolution of the drive roller, said interrupting means extending through and slidably attached to said apparatus support means adjacent said guide roller at said apparatus support means first side edge, said interrupting means interconnected to said drive roller wherein activation of said interrupting means controllably stops the revolution of said drive roller.

6. The apparatus of claim 2 comprising: comprising:

(a) high pressure water means for washing hose comprising a first and second cleaning head, said first cleaning head comprising a perpendicular length mounted on and passing through said apparatus support means adjacent said apparatus support means top and first side edges, said first cleaning head comprising two or more spray nozzles for directing water generally parallel to said apparatus support means in an area generally adjacent to said apparatus support means, said second cleaning head comprising a perpendicular length mounted on and passing through said apparatus support means adjacent said apparatus support means bottom edge and middle area, said second cleaning head comprising two or more spray nozzles for directing water generally parallel to said apparatus support means in an area adjacent said apparatus support means; and (b) means for guiding hose through the apparatus comprising a first and second guide roller rotatably attached to said apparatus support means, said first guide roller comprising a length extending outward from said apparatus support means adjacent and parallel to said first cleaning head in the path of said first cleaning head nozzles, said second guide roller comprising a length extending outward from said apparatus support means adjacent said second cleaning head in the path of said second cleaning head nozzles.

7. The apparatus of claim 6 comprising a third guide roller comprising a perpendicular length extending outwardly from, and rotatably attached to, said apparatus support means adjacent said drive roller and said apparatus support means top and second side edges and, wherein said first cleaning head nozzles are directed downward, said second cleaning head nozzles are directed upward, and said first, second, and third guide rollers are positioned to transport hose in a serpentine pattern across the surface of said apparatus support means.

8. A hose washing apparatus comprising:

(a) means for supporting the apparatus, said support means comprising a rigid structure, said structure further comprising a top edge and bottom edge and first and second side edges between which lies a middle area;

(b) a high pressure water source producing water at a pressure ranging from about 200 psi to 1000 psi and a flow rate of about 2 gpm to 10 gpm;

(c) means for washing hose mounted to the apparatus support means, said washing means in communication with said high pressure water source and comprising one or more nozzles for directing water towards in an area adjacent said apparatus support means;

(d) means for guiding hose through the apparatus, said guiding means rotatably mounted to said apparatus support means and comprising at least one guide roller, said guide roller comprising a length extending outwardly from said apparatus support means and oriented generally perpendicular relative to said apparatus support means, said guide roller mounted to said apparatus support means adjacent said hose washing means in the path of said nozzles; and (e) means for driving hose through the apparatus, said drive means comprising a drive roller and a pressure roller each mounted to said apparatus support means, said drive roller positioned adjacent said apparatus support means second side edge, said pressure roller comprising a rotatable length in tension contact with said drive roller, said pressure roller positioned parallel to said drive roller and perpendicular to said apparatus support means, said pressure roller supportably mounted to said apparatus support means through a spring.

9. The apparatus of claim 8 wherein said apparatus support means comprises a rigid back plate having a thickness, length, and width adequate to apparatus support the hose washing apparatus.

10. The apparatus of claim 8 wherein said hose washing means comprises at least one cleaning head, said cleaning head comprising a perpendicular length mounted on and passing through said apparatus support means outwardly beyond the apparatus support means, said nozzles positioned across said cleaning head length.

11. The apparatus of claim 8 comprising:

(a) high pressure water means for washing hose comprising a first and second cleaning head, said first cleaning head comprising a perpendicular length mounted on and passing through said apparatus support means adjacent said apparatus support means top and first side edges, said first cleaning head comprising two or more spray nozzles for directing water generally parallel to said apparatus support means in an area generally adjacent to said apparatus support means, said second cleaning head comprising a perpendicular length mounted on sand passing through said apparatus support means adjacent said apparatus support means bottom edge and middle area, said second cleaning head comprising two or more spray nozzles for directing water generally parallel to said apparatus support means in an area adjacent said apparatus support means; and (b) means for guiding hose through the apparatus comprising a first and second guide roller rotatably attached to said apparatus support means, said first guide roller comprising a length extending outward from said apparatus support means adjacent and parallel to said first cleaning head in the path of said first cleaning head nozzles, said second guide roller comprising a length extending outward from said apparatus support means adjacent said second cleaning head in the path of said second cleaning head nozzles.

12. The apparatus of claim 11 comprising a third guide roller comprising a perpendicular length extending outwardly from, and rotatably attached to, said apparatus support means adjacent said drive roller and said apparatus support means top and second side edges and, wherein said first cleaning head nozzles are directed downward, said second cleaning head nozzles are directed upward, and said first, second, and third guide rollers are positioned to transport hose in a serpentine pattern across the surface of said apparatus support means.

13. The apparatus of claim 8, wherein said drive roller is externally connected to a power source used to rotate said drive roller.

14. The apparatus of claim 13 additionally comprising means for interrupting the revolution of the drive roller, said interrupting means extending through and slidably attached to said apparatus support means adjacent said guide roller at said apparatus support means first side edge, said interrupting means interconnected to said drive roller wherein activation of said interrupting means controllably stops the revolution of said drive roller.

15. A high water pressure, fire hose washing apparatus comprising:

(a) a back plate, said back plate comprising a thickness, length, and width sufficient to support the apparatus, said back plate having a generally square shape defined by a top edge, bottom edge, and first and second side edges between which lies a middle area;

(b) a first and second cleaning head, said first cleaning head comprising a perpendicular length passing through and extending outwardly beyond said back plate generally towards said back plate top and first side edges, said first cleaning head comprising at least two nozzles positioned across said first cleaning head length, said nozzles positioned to direct the water generally parallel to the back plate towards said back plate top edge, said second cleaning head comprising a perpendicular length passing through and extending outwardly beyond said back plate generally toward said back plate bottom and second side edges diagonally downward from said first cleaning head, said second cleaning head comprising at least two spray nozzles positioned across said second cleaning head length, said nozzles generally positioned to direct water upward generally parallel to said back plate in an area adjacent said back plate;

(c) a first, second, and third guide roller, said guide rollers each comprising a perpendicular length rotatably attached to said back plate and extending outwardly from said back plate, said guide rollers oriented to direct hose in a generally serpentine pattern, said first guide roller attached to said back plate adjacent said first cleaning head and oriented generally parallel and beneath said first cleaning head in the path of said first cleaning head nozzles, said second guide roller attached to said back plate adjacent said second cleaning head and oriented generally parallel add above said second cleaning head in the path of said second cleaning head nozzles, said third guide roller attached to said back plate adjacent said back plate top edge and second side edge;

(d) a drive roller rotatably attached to said back plate adjacent said back plate second side edge, said drive roller comprising a length extending beyond said back plate, wherein said drive roller is rotatable at various speeds by connection of said drive roller to an external power source; and (e) a pressure roller positioned in tension contact with said drive roller, said pressure roller rotatably attached to said back plate by a spring, said pressure roller comprising a length generally held perpendicular to said back plate and parallel to said drive roller.

16. The apparatus of claim 15 further comprising first and second sets of guide pins, said guide pins sets mounted on to said back plate and comprising a length extending outwardly from said back plate oriented perpendicular to said back plate, said first guide pins set positioned adjacent said first guide roller towards the back plate first side edge, said second guide pin set positioned adjacent said back plate second side edge between said third guide roller and said drive roller.

17. The apparatus of claim 15 further comprising means for interrupting the revolution of said drive roller, said interrupting means slidably attached to said back plate adjacent said first guide rollers at said back plate first side edge, said interrupting means interconnected to said drive roller wherein activation of said interrupting means controllably stops the revolution of said drive roller.

18. A high water pressure cleaning system comprising:

(a) a high pressure water source producing water at a pressure ranging from about 200 psi to 1000 psi; and (b) a hose washing apparatus comprising:

(i) means for supporting the apparatus, said apparatus support means comprising a rigid structure, (ii) means for supporting the hose on the apparatus, said hose support means affixed to said apparatus support means, (iii) high pressure water means in communication with said high pressure water source for washing hose mounted to the apparatus support means comprising a first and second cleaning head, said first cleaning head comprising a perpendicular length mounted on and passing through said apparatus support means, said first cleaning head comprising two or more spray nozzles for directing water generally parallel to said apparatus support means in an area generally adjacent to said apparatus support means, said second cleaning head comprising a perpendicular length mounted on and passing through said apparatus support means, said second cleaning head comprising two or more spray nozzles for directing water generally parallel to said apparatus support means in an area adjacent said apparatus support means; and, (iv) means for guiding hose through the apparatus comprising a first and second guide roller rotatably attached to said apparatus support means, said first guide roller comprising a length extending outward from said apparatus support means adjacent and parallel to said first cleaning head in the path of said first cleaning head nozzles, said second guide roller comprising a length extending outward from said apparatus support means adjacent said second cleaning head in the path of said second cleaning head nozzles.

19. The system of claim 18 comprising a third guide roller comprising a perpendicular length extending outwardly from, and rotatably attached to said apparatus support means adjacent said drive roller on said apparatus support means top and second side edges and, wherein said first cleaning head is directed downward, said second cleaning head is directed upward, and said first, second, and third guide rollers are positioned to transport hose in a serpentine pattern across the surface of said apparatus support means.

* * * * *